US011524269B2

(12) United States Patent
Imai et al.

(10) Patent No.: US 11,524,269 B2
(45) Date of Patent: Dec. 13, 2022

(54) MIXING IMPELLER AND TREATMENT APPARATUS

(71) Applicant: Microwave Chemical Co., Ltd., Osaka (JP)

(72) Inventors: Masahiro Imai, Osaka (JP); Takanobu Murata, Osaka (JP); Hisao Watanabe, Osaka (JP); Hideshi Kurihara, Osaka (JP)

(73) Assignee: MICROWAVE CHEMICAL CO., LTD., Osaka (JP)

( * ) Notice: Subject to any disclaimer, the term of this patent is extended or adjusted under 35 U.S.C. 154(b) by 349 days.

(21) Appl. No.: 16/465,371

(22) PCT Filed: Jun. 28, 2017

(86) PCT No.: PCT/JP2017/023742
§ 371 (c)(1),
(2) Date: May 30, 2019

(87) PCT Pub. No.: WO2018/105159
PCT Pub. Date: Jun. 14, 2018

(65) Prior Publication Data

US 2019/0388854 A1 Dec. 26, 2019

(30) Foreign Application Priority Data

Dec. 7, 2016 (JP) ..... JP2016-237861

(51) Int. Cl.
*B22C 5/00* (2006.01)
*B01F 27/60* (2022.01)
(Continued)

(52) U.S. Cl.
CPC ..... *B01F 27/60* (2022.01); *B01F 27/112* (2022.01); *B01F 2101/2204* (2022.01)

(58) Field of Classification Search
CPC ..... B01F 7/02
See application file for complete search history.

(56) References Cited

U.S. PATENT DOCUMENTS 4,159,181 A 6/1979 Perrine
5,318,360 A * 6/1994 Langer ..... B01F 23/2331 261/87
(Continued)

FOREIGN PATENT DOCUMENTS

DE 281 168 C 6/1926
DE 28 03 407 A1 8/1979
(Continued)

OTHER PUBLICATIONS

Machine translation for JP-59047735-U labeled "JP59047735UMT" (Year: 1984).*
(Continued)

*Primary Examiner* — Anshu Bhatia
*Assistant Examiner* — Gregory Y Huan
(74) *Attorney, Agent, or Firm* — Troutman Pepper Hamilton Sanders LLP

(57) ABSTRACT

The present invention provides a mixing impeller and the like capable of properly performing mixing. A mixing impeller includes multiple blade pairs each having two blades, wherein the blades included in the multiple blade pairs are attached around a rotational shaft extending in a lateral direction, so as to be positioned at a same position in an axial direction of the rotational shaft, the two blades of each blade pair each have a shape that is symmetric about a symmetry plane that is a plane perpendicular to the rotational shaft, the two blades of each blade pair are formed so as to extend from the rotational shaft side toward an outer circumferential side, which is a side opposite to the rotational shaft side, and blade outer portions that are on the
(Continued)

outer circumferential side are bent toward a side on which the two blades face each other.

8 Claims, 7 Drawing Sheets

(51) Int. Cl.
*B01F 27/112* (2022.01)
*B01F 101/00* (2022.01)

(56) References Cited

U.S. PATENT DOCUMENTS

| | | | |
|---|---|---|---|
| 2006/0104874 | A1 | 5/2006 | Gebhart et al. |
| 2008/0164624 | A1 | 7/2008 | Wu |

FOREIGN PATENT DOCUMENTS

| | | | | |
|---|---|---|---|---|
| JP | 57-87032 | U | | 11/1980 |
| JP | 59-47735 | U | | 3/1984 |
| JP | 59047735 | U | * | 3/1984 |
| JP | 60-6412 | Y2 | | 3/1985 |
| JP | 63-28996 | Y2 | | 8/1988 |
| JP | 5-36493 | Y2 | | 9/1993 |
| JP | 9-29213 | A | | 2/1997 |
| JP | 2002-360219 | A | | 12/2002 |
| JP | 2007-283188 | A | | 11/2007 |
| JP | 2013-103160 | A | | 5/2013 |

OTHER PUBLICATIONS

Extended European Search Report issued in corresponding European Patent Application No. 17 87 8701 dated Jul. 15, 2020.

Communication pursuant to Article 94(3) EPC issued in corresponding European Patent Application No. 17 878 701 dated Mar. 24, 2021.

The First Office Action issued in corresponding Chinese Patent Application No. 201780072922.5 dated Feb. 2, 2021, with English translation.

International Search Report issued in corresponding International Patent Application No. PCT/JP2017/023742 dated Aug. 29, 2017.

Notice of Reasons for Refusal issued in corresponding Japanese Patent Application No. 2016-237861 dated Feb. 28, 2017.

* cited by examiner

| | Mixing impeller1c | Mixing impeller31 | Mixing impeller32 |
|---|---|---|---|
| Mixed state | | | |
| 25 rpm | ○ | ○ | ○ |
| 50 rpm | ○ | ○ | ○ |
| Raising of fluid (visual) | | | |
| 25 rpm | Approx. 0 mm | About 8 mm | About 10 mm |
| 50 rpm | About 5 mm | About 8 mm | About 25 mm |

FIG.7

MIXING IMPELLER AND TREATMENT APPARATUS

CROSS REFERENCE TO RELATED APPLICATIONS

This is a U.S. National Phase Application under 35 U.S.C. § 371 of International Patent Application No. PCT/JP2017/023742, filed Jun. 28, 2017, which claims priority of Japanese Patent Application No. 2016-237861, filed Dec. 7, 2016. The entire contents of which are hereby incorporated by reference.

TECHNICAL FIELD

The present invention relates to a mixing impeller and the like for mixing a treatment target in a lateral treatment apparatus.

BACKGROUND

As a conventional technique, chemical reaction apparatuses are known in which a blade-like member or the like is arranged on a rotational shaft extending in a flow direction of a lateral reactor (see JP 2016-237861 A, for example).

SUMMARY

However, conventional techniques are problematic in that it may be difficult to properly mix a treatment target.

For example, when mixing a treatment target such as a liquid or a powder that flows, the surface of the treatment target may be partially raised due to the mixing. For example, during mixing, the side of a treatment target on which a mixing blade is pulled upward out of the treatment target may be raised, and the side thereof on which the mixing blade is pushed into the treatment target may be lowered, resulting in an inclination of the surface of the treatment target. When the surface is raised or inclined, the treatment target may adhere to a wall face or the like that has not been in contact with the treatment target when the mixing is not performed, in a vessel in which treatment target is placed. When the treatment target adheres, the adhering portion of the treatment target may be dried or burnt due to the heating of the vessel. There is a problem that such a dried or burnt treatment target is mixed into a treatment target that is being mixed.

Furthermore, especially in flow-type reactors or the like having a partition plate as shown in, for example, FIG. 2 of JP 2016-237861 A above, when the surface of a treatment target is raised due to mixing as described above, a treatment target that is not stably retained in an area defined by the partition plate may flow from the raised portion over the partition plate into an adjacent area, and thus, compared with a case in which the surface is prevented from being raised and the treatment target is allowed to naturally flow over the partition plate, there is a problem that the time during which the treatment target is retained in an area defined by the partition plate is unlikely to be kept uniform and the treatment time on the treatment target is unlikely to be kept uniform, and thus it is not possible to perform uniform treatment.

On the other hand, even in a case in which the treatment target is prevented from being raised, by suppressing movement and the like of the treatment target due to mixing, there is a problem that it is not possible to perform uniform treatment on the treatment target if the treatment target cannot be sufficiently mixed.

The present invention was arrived at in order to solve the above-described problems, and it is an object thereof to provide a mixing impeller and the like capable of properly mixing a treatment target.

The present invention is directed to a mixing impeller including multiple blade pairs each having two blades, wherein the blades included in the multiple blade pairs are attached around a rotational shaft extending in a lateral direction, so as to be positioned at a same position in an axial direction of the rotational shaft, the two blades of each blade pair each have a shape that is symmetric about a symmetry plane that is a plane perpendicular to the rotational shaft, and the two blades of each blade pair are formed so as to extend from the rotational shaft side toward an outer circumferential side, which is a side opposite to the rotational shaft side, and blade outer portions that are on the outer circumferential side are bent toward a side on which the two blades face each other.

With this configuration, it is possible to properly mix a treatment target by suppressing raising of the treatment target while allowing the treatment target to flow.

Furthermore, the mixing impeller of the present invention is such that each blade outer portion is bent so as to form an obtuse angle with a portion extending from the rotational shaft side toward a bent portion at which the blade outer portion is bent, of the blade including the blade outer portion.

With this configuration, it is possible to properly mix a treatment target by suppressing raising of the treatment target.

Furthermore, the mixing impeller of the present invention is such that, in the two blades of each blade pair, at least bent sections of portions that are bent toward the facing side are provided with openings.

With this configuration, it is possible to properly release the outside air captured by the treatment target.

Furthermore, the mixing impeller of the present invention is such that, in the two blades of each blade pair, portions that are bent toward the facing side and that intersect the symmetry plane are provided with slit-like openings.

With this configuration, it is possible to properly release the outside air captured by the treatment target.

Furthermore, the mixing impeller of the present invention is such that, in each portion extending from the rotational shaft side toward a bent portion at which the blade outer portion is bent, of the two blades of each blade pair, a portion that intersects the symmetry plane is bent so as to project toward a side opposite to the side on which the two blades face each other.

With this configuration, it is possible to cause the outside air captured by the treatment target to accumulate on the side opposite to the projecting portion of the blade.

Furthermore, the mixing impeller of the present invention is such that each blade is attached to the rotational shaft so as to have an opening between the portion extending from the rotational shaft side toward the bent portion of the blade, and the rotational shaft.

With this configuration, it is possible to release the outside air that has been captured by the treatment target accumulating on the blade, from the opening into the treatment target.

Furthermore, the mixing impeller of the present invention is such that the mixing impeller further includes plate-like members attached to both sides of the blades.

With this configuration, it is possible to increase the efficiency of the mixing.

Furthermore, the mixing impeller of the present invention is such that the plate-like members attached to both sides of the blades have a shape extending to sides in which the blades are bent and conforming to bending of the blades.

With this configuration, it is possible to increase the efficiency of the mixing.

The present invention is directed to a treatment apparatus including: a treatment vessel with a shape extending in a lateral direction; one or more partition plates arranged inside the treatment vessel so as to intersect a direction in which the treatment vessel extends, and arranged so as to have an opening between the partition plates and an upper face of an internal portion of the treatment vessel; a rotational shaft arranged inside the vessel in a direction in which the vessel extends; and the above-described mixing impeller, in one or more areas defined by the one or more partition plates inside the vessel.

With this configuration, it is possible to properly mix a treatment target. Accordingly, for example, it is possible to perform treatment while suppressing a deterioration in the quality.

With the mixing impeller and the like according to the present invention, it is possible to properly mix a treatment target.

BRIEF DESCRIPTION OF DRAWINGS

FIG. 7 is a table showing a result of an experiment for checking a state of a treatment target mixed by the mixing impeller in the embodiment.

DETAILED DESCRIPTION

Figure 1A:
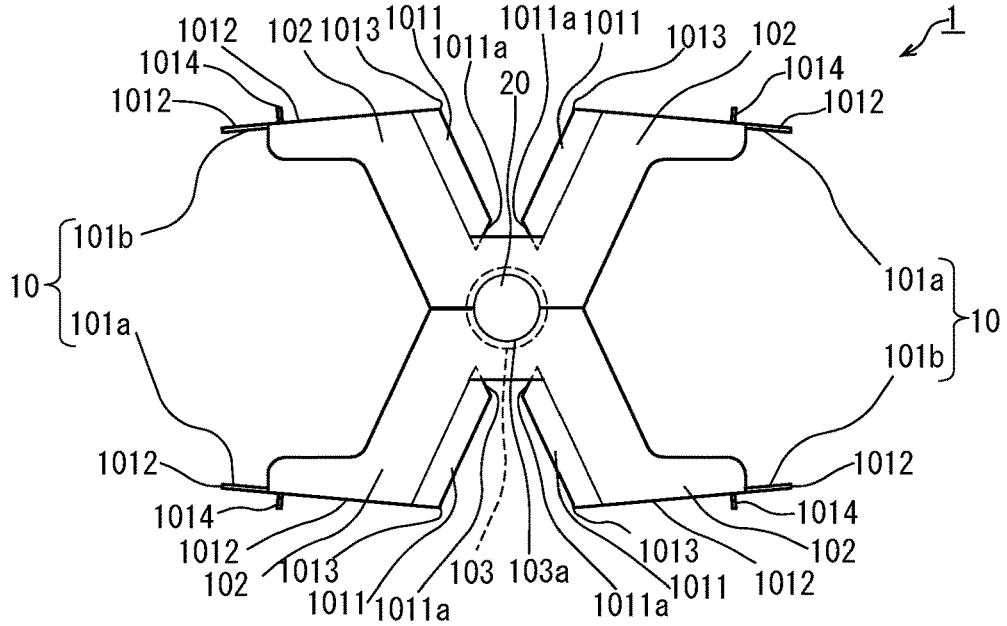
FIG. 1 shows a front view (FIG. 1(*a*)), a top view (FIG. 1(*b*)), and a right side view (FIG. 1(*c*)) of a mixing impeller in an embodiment of the present invention.

Hereinafter, an embodiment of a mixing impeller and the like will be described with reference to the drawings. It should be noted that constituent elements denoted by the same reference numerals in the embodiments perform similar operations, and thus a description thereof may not be repeated.

Figure 1B:
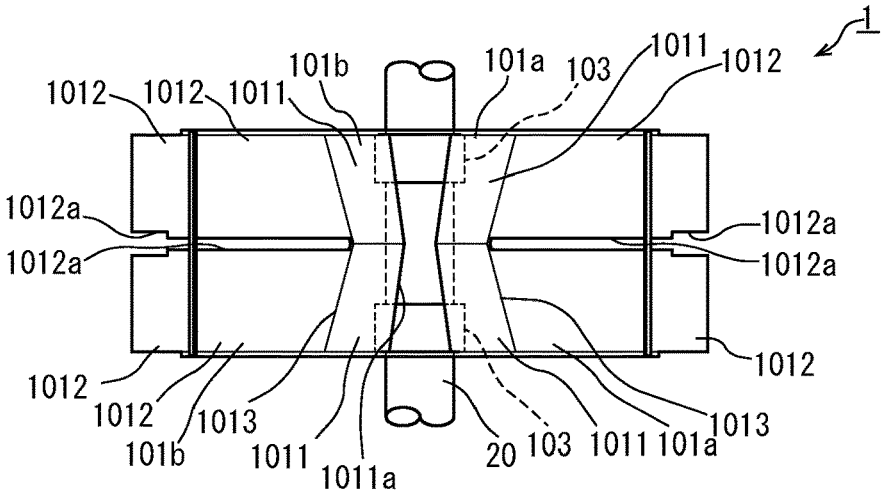
Figure 1C:
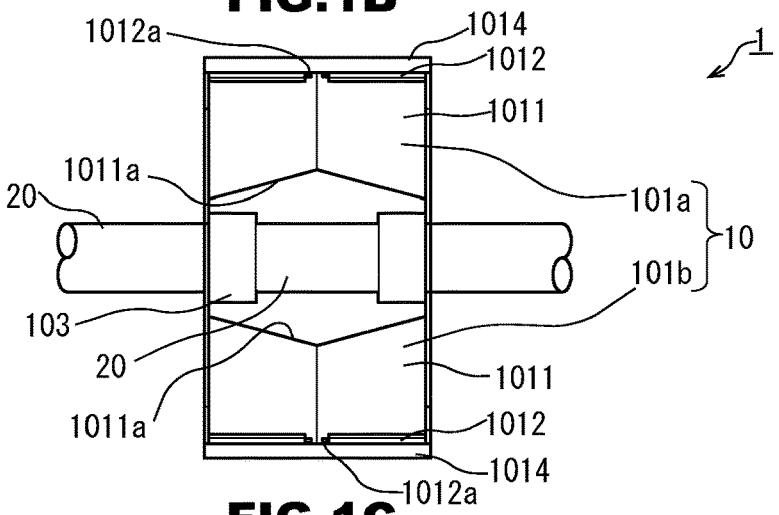

FIG. 1 shows a front view (FIG. 1(*a*)), a top view (FIG. 1(*b*)), and a right side view (FIG. 1(*c*)) of a mixing impeller 1 in this embodiment.

Figure 2:
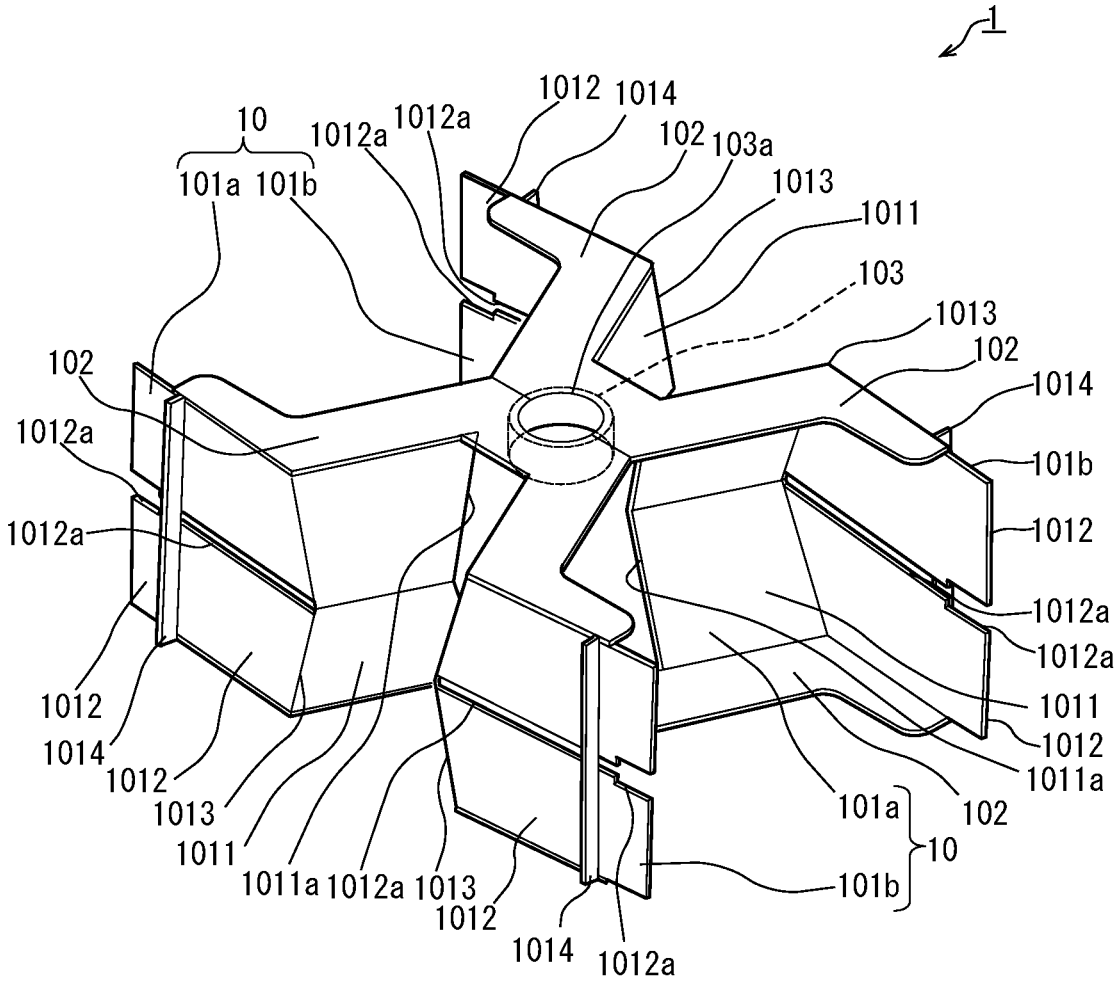
FIG. 2 is a perspective view of the mixing impeller in the embodiment.

FIG. 2 is a perspective view of the mixing impeller 1 in this embodiment. This perspective view is a perspective view showing a case in which the mixing impeller 1 is arranged such that its front face is positioned on the upper side. Note that FIG. 2 shows a state in which a rotational shaft 20 is not attached to the mixing impeller 1.

Figure 3A:
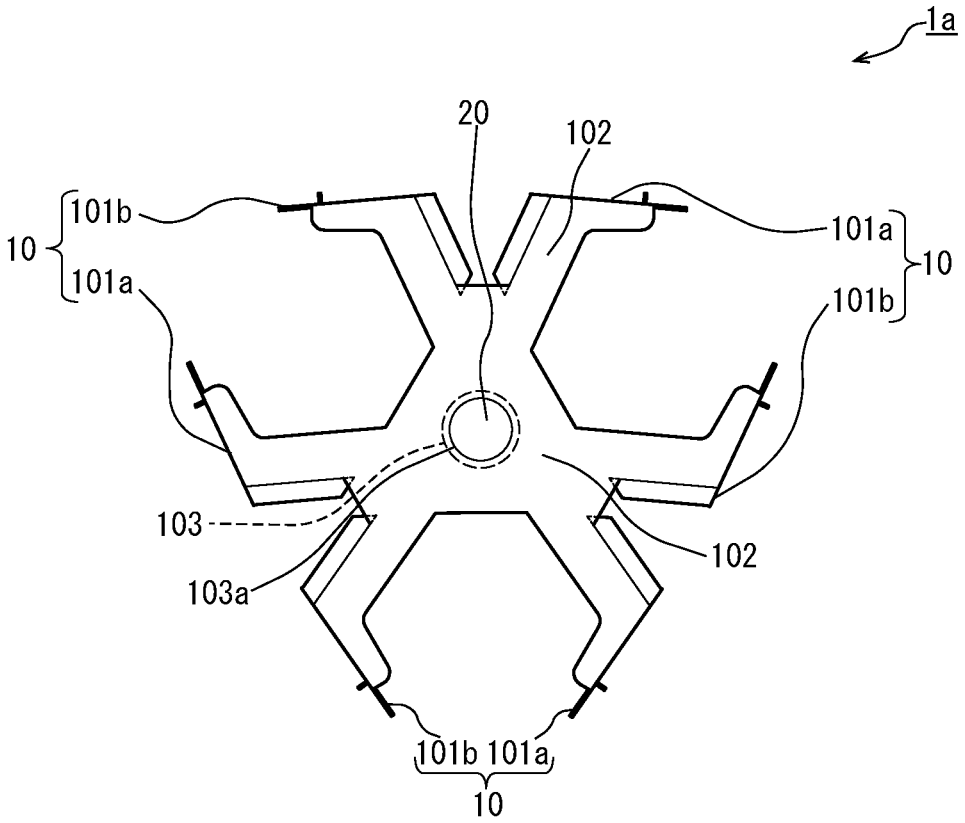
FIG. 3 shows a view showing a first modified example (FIG. 3(*a*)) and a view showing a second modified example (FIG. 3(*b*)) of the mixing impeller in the embodiment.
Figure 3B:
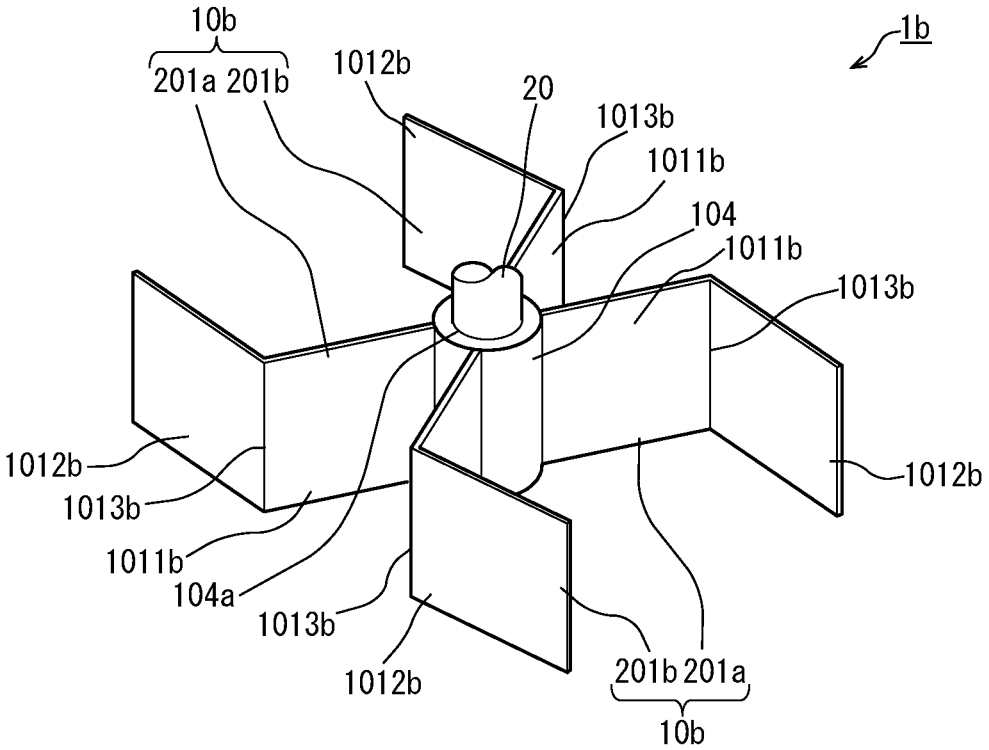

FIG. 3 shows a front view showing a first modified example (FIG. 3(*a*)) and a perspective view (FIG. 3(*b*)) showing a second modified example of the mixing impeller in this embodiment. This perspective view is a perspective view showing a case in which a mixing impeller 1*b* is arranged such that its front face is positioned on the upper side.

The mixing impeller 1 includes two blade pairs 10, plate-like members 102, and fixing members 103.

Each blade pair 10 includes two blades 101*a* and 101*b*. In this example, a blade that is positioned on the left side, when viewed from the front in a state in which each blade pair 10 is arranged such that the rotational shaft 20 is positioned on the lower side, is taken as a blade 101*a*, and a blade that is positioned on the left side is taken as a blade 101*b*. It is assumed that the front face in this example is, for example, a face that is seen when the mixing impeller 1 is viewed in a state in which the line-of-sight direction is set along the direction in which the rotational shaft 20 extends. Note that, in a case in which the blades 101*a* and 101*b* do not have to be particularly distinguished from each other, for the sake of ease of description, they may be each simply referred to as a blade 101.

The two blades 101*a* and 101*b* of each of the blade pairs 10 are attached to the rotational shaft 20 so as to face each other in the rotational direction of the rotational shaft 20 extending in the lateral direction. The two blades 101*a* and 101*b* of one blade pair are arranged around the rotational shaft 20 so as to be adjacent to each other. The lateral direction in this example is typically a horizontal direction, but may be considered as including a direction that is inclined within ±10 degrees relative to the horizontal direction. The lateral direction may be considered as also including a direction that is inclined within ±30 degrees relative to the horizontal direction. The lateral direction in this example may be considered as the longitudinal direction of a lateral treatment vessel (not shown) in which the mixing impeller 1 is arranged. The rotational direction in this example may be considered as a direction having no element in the axial direction of the rotational shaft 20. The axial direction of the rotational shaft 20 is, for example, a direction in which the rotational shaft 20 extends. The state in which two blades 101 face each other in the rotational direction may be considered, for example, as a state in which they face each other in a direction along the circumference of a circle that is centered about a point on the central axis of the rotational shaft 20, and that is perpendicular to the axial direction of the rotational shaft 20. The point on the central axis in this example is, for example, a point indicating a position in the axial direction to which the two blades 101 are attached. There is no limitation on whether the rotational direction of the rotational shaft 20 is the rightward direction or the leftward direction.

Two blades 101 constituting one blade pair 10 may be directly attached to the rotational shaft 20, or may be indirectly attached to the rotational shaft 20. There is no limitation on the attachment structure and the like of the two blades 101. For example, two blades 101 included in one blade pair 10 have through holes into which the rotational shaft 20 is to be inserted, and may be directly attached to a side face or the like of a fixing member (not shown) in the shape of a cylinder extending in a direction in which the through holes extend. In this example, a case is shown as an example in which the plate-like members 102 are attached to both sides of two blades 101 included in one blade pair 10, the cylindrical fixing members 103 having cylindrical through holes 103*a* through which the rotational shaft 20 is inserted are attached to the rotational shaft 20 side of the plate-like members 102, and the two blades 101 are indirectly attached to the rotational shaft 20 by inserting the rotational shaft 20 into the through holes 103*a* of the two fixing members 103. The through holes 103*a* is typically in the shape of a cylinder or a partially cut away cylinder, but there is no limitation on the shape of the through holes 103*a*. The fixing members 103 are in the shape of, for example, a cylinder or a polygonal prism. Both sides of the blades 101 may be considered, for example, as both sides along a direction that extends outward from the rotational shaft 20, or may be considered as ends of the blades 101 positioned in a direction in which the central shaft 20 extends. The same applies to the description below. The fixing members 103 attached to the plate-like members 102 may be configured by two members respectively including recesses that can hold the rotational shaft 20 therebetween when the members are placed overlapping each other, and a hole formed by the recesses when the members are placed overlapping each other may be taken as, for example, a hole corresponding to the through holes 103*a* described above. Note that the rotational shaft 20 may or may not be considered as part of the mixing impeller 1.

The blades 101*a* and 101*b* of each of the blade pairs 10 are attached around the rotational shaft 20 extending in the lateral direction, so as to be positioned at the same position in the axial direction of the rotational shaft 20. Two blades 101 included in one blade pair 10 each have a shape that is symmetric about a plane perpendicular to the rotational shaft 20. Accordingly, the two blades 101*a* and 101*b* of each of the blade pairs 10 are attached around the rotational shaft 20 so as to face each other in the rotational direction of the rotational shaft 20. The plane perpendicular to the rotational shaft 20 is a symmetry plane of the blade 101. Each blade 101 may be considered as having a shape that is symmetric about a symmetry plane that is a plane perpendicular to the rotational shaft 20. The symmetry plane is a virtual plane. The symmetry plane may be considered as a plane functioning as a symmetry reference of the blade 101. The symmetry reference may be considered as a center of symmetry. The plane perpendicular to the rotational shaft 20 in this example is, for example, a plane perpendicular to a direction in which the rotational shaft 20 extends, that is, to the axial direction. The shape that is symmetric about a symmetry plane in this example may be a shape that seems to be substantially symmetric, or may be a shape that seems to be nearly symmetric. For example, the blade 101 may be considered as being symmetric also in a case in which part of the blade is cut out or in which a protrusion or the like is provided. If the blade 101 has a shape that seems to be substantially symmetric, for example, it is possible that the center in the width direction of the blade 101 is slightly displaced from a point at which the blade 101 is in contact with the symmetry plane. The width direction of the blade 101 is a direction perpendicular to the direction in which the blade 101 extends, and the same applies to the description below.

The two blades 101*a* and 101*b* of each of the blade pairs 10 are formed so as to extend from the rotational shaft 20 side toward the outer circumferential side, which is the side opposite to the rotational shaft 20, stated otherwise, on the periphery of the mixing impeller 1. The outer circumferential sides (i.e. the blade portions) of the two blades 101*a* and 101*b* of each of the blade pairs 10 are bent toward the side on which the two blades 101*a* and 101*b* face each other, or stated differently, angled inwardly with respect to the blade inner portion 1011. In this example, for the sake of ease of description, the outer circumferential side of each blade 101 is referred to as a blade outer portion 1012. The portion of each blade 101 from the rotational shaft 20 side to the blade outer portion 1012 is referred to as a blade inner portion 1011, and the bent section of the blade 101, for example, the section that is a boundary between the blade inner portion 1011 and the blade outer portion 1012 is referred to as a bent portion 1013. The side on which two blades 101 of one blade pair 10 face each other may be considered as an inner side of the two blades 101. In this example, the blade outer portion 1012 of the blade 101*a* is bent inwardly toward the blade 101*b* (i.e., in a direction closer to the blade 101*b*), and the blade outer portion 1012 of the blade 101*b* is bent inwardly toward the blade 101*a* (i.e., in a direction closer to the blade 101*a*). Two blades 101 included in one blade pair 10 have, for example, faces that face each other with a plane including the central axis of the rotational shaft 20 interposed therebetween. For example, the blade inner portions 1011 of the two blades 101 have faces that face each other with a plane including the central axis of the rotational shaft 20 interposed therebetween, and the blade outer portions 1012 of the two blades 101 have faces that face each other with a plane including the central axis of the rotational shaft 20 interposed therebetween. The faces that face each other are, for example, faces inclined relative to a plane that is perpendicular to the axial direction of the rotational shaft 20. The faces that face each other may or may not be perpendicular to a plane that is perpendicular to the axial direction of the rotational shaft 20. The plane including the central axis of the rotational shaft 20 in this example is a virtual plane. It is also possible that the faces that face each other in this example are curved faces.

It is preferable that the blade outer portion 1012 is bent so as to form an obtuse angle with the blade inner portion 1011, which is a portion extending from the rotational shaft side toward the bent portion 1013 at which the blade outer portion 1012 is bent, in the blade 101 including this blade outer portion 1012. Accordingly, it is possible to properly suppress movement (e.g., raising, etc.) of the surface of the treatment target, for example, during mixing. The bending angle is preferably from 100 to 130 degrees, and more preferably from 105 to 125 degrees. The bent section of the blade 101 may or may not be chamfered. If the bent portion is chamfered, the radius of curvature of the chamfered curved face is preferably smaller. The treatment target may be considered as a material that is to be mixed. The treatment target will be described later. The ratio of the length of the blade outer portion 1012 with respect to the distance from the central axis of the rotational shaft 20 to the bent portion 1013 is preferably, for example, from 1:0.5 to 1:1.5. Note that, as described later, since the portion, of the blade inner portion 1011, that intersects the symmetry plane of the blade 101 is bent so as to project toward the side opposite to the side on which the blades 101 face each other, alternately described as angled outwardly, wherein outwardly is in a direction opposite an area between the blades of the blade pair 10, for example, if the bent portion 1013 that is a portion in contact with the blade inner portion 1011 is not in the shape of a straight line, the bent portion 1013 that is used as a reference of the lengths of the blade inner portion 1011 and the blade outer portion 1012 may be the portion, of the bent portion 1013 of the blade 101, that intersects the symmetry plane of the blade 101, for example, the portion, of the ridge of the blade inner portion 1011*b* bent so as to project toward the side opposite to the side on which the blades 101 face each other, that intersects the symmetry plane of the blade 101, or may be other portions of the bent portion 1013, for example, an end of the bent portion 1013 in the width direction of the blade 101. If the bent portion 1013 is chamfered (e.g., the bent portion 1013 is constituted by curved faces), the bent portion 1013 that is used as a reference of the lengths of the blade inner portion 1011 and the blade outer portion 1012 may be any portion in the bent portion 1013, and may be, for example, the portion in the bent portion 1013 that is closest to the blade inner portion 1011, the portion in the bent portion 1013 that is closest to the blade outer portion 1012, or a portion that is located between the blade inner portion 1011 and the blade outer portion 1012. The portion that is used as a reference of the length of the bent portion 1013 in this example may be a point of a portion in which a portion obtained by extending the surface of the blade inner portion 1011 a portion obtained by extending the surface of the blade outer portion 1012 intersect each other. The portion obtained by extending the surface of the blade inner portion 1011 in this case may be a portion obtained by extending the ridge of the blade inner portion 1011. Note that there is no limitation on the relationship between the distance from the central axis of the rotational shaft 20 to the bent portion 1013 and the length of the blade outer portion 1012. This relationship may be set as appropriate, for example, according to the treatment target, the rotational speed, and the like.

The blade 101 may be formed by bending one member, or by connecting multiple members through welding or using a fastener or the like such as a bolt. For example, it is also possible that one blade 101 is formed by connecting a member constituting the blade inner portion 1011 and a member constituting the blade outer portion 1012 through welding or the like. The same applies to other members.

In this embodiment, an example is shown in which the blade 101 is constituted by a flat plate-like member or is formed by bending a flat plate-like member or the like, but, in the present invention, at least part of the blade 101 may be constituted by a member other than a flat plate-like member, as long as, eventually, a decrease in the efficiency or the like of mixing by the mixing impeller 1, an increase in movement of the surface of the treatment target during mixing, and the like are prevented, or a decrease in the efficiency or the like of mixing, an increase in movement of the surface of the treatment target, and the like are kept within an allowable range. Examples of the member other than a flat plate-like member include one or more members such as a perforated plate with one or more holes (e.g., a punched plate), a wire mesh, and a rod-like member.

The plate-like members 102 are attached to both sides of the blades 101. Both sides of the blades 101 are, for example, ends in the width direction of the blades 101. The plate-like members 102 attached to the blades 101 included in one blade pair 10 have shapes extending toward the sides in which the blades 101 are bent, in other words, toward the side on which one pair of blades 101 face each other. The shapes extending toward the sides in which the blades 101 are bent may be considered as shapes spreading toward the sides in which the blades 101 are bent. In this embodiment, a case is shown in which the plate-like members 102 have shapes conforming to the bending of the blades 101, that is, shapes bent along the blades 101 when viewed from the front of the mixing impeller 1. Note that the plate-like members 102 may have shapes not bent along the blades 101. For example, the plate-like members 102 may be in the shape of a circle that is centered about the rotational shaft 20. Since the plate-like members 102 are provided, it is possible to improve the efficiency of the mixing.

The plate-like member 102 does not have to be arranged throughout a side of the entire blade 101. For example, in this embodiment, the plate-like member 102 is not provided at an end of the blade outer portion 1012 on the side opposite to the bent portion 1013. In the case in which the plate-like member 102 is provided, when the plate-like member 102 is pulled out of the treatment target during mixing, depending on the treatment target, splashes of the treatment target that has been caught on the plate-like member 102 to a wall face of the treatment vessel or the like may occur. Such splashes may affect the quality of the treatment target. However, since the plate-like member 102 is not provided at an end of the blade outer portion 1012 on the side opposite to the bent portion 1013, it is possible to suppress such splashes.

In this embodiment, a case is shown as an example in which the blades 101 are not directly attached to the rotational shaft 20 or the fixing members 103, and are indirectly attached to the rotational shaft 20 via the plate-like members 102, but it is also possible that the blades 101 are directly attached to the rotational shaft 20 or the fixing members 103.

In the two blades 101*a* and 101*b* of one blade pair 10 attached so as to face each other, the portions that are bent toward the facing side and that intersect the symmetry plane of the blades 101 are provided with slit-like openings 1012*a*. The portions that are bent toward the facing side, of the blades 101, are, for example, the blade outer portions 1012. The slit-like openings 1012*a* in this example are arranged so as to extend from the bent portions 1013 to the ends of the blade outer portions 1012. Note that the openings 1012*a* do not have to extend to the ends of the blade outer portions 1012, and may be disconnected in the middle. The widths of the openings 1012*a* in this example are not constant, and there is no limitation on whether or not the widths of the openings 1012*a* are constant. In this example, the slit-like openings 1012*a* are provided on the blade outer portions 1012, and thus plate-like reinforcing members 1014 for reinforcement are provided across the openings 1012*a* in order to reinforce the strength of the blade outer portions 1012. Since the slit-like openings 1012*a* are provided on the blade outer portions 1012, the outside air and the like captured by the blades 101 during mixing can be gradually released into the treatment target from the slit-like openings 1012*a*, and thus it is possible to prevent the outside air captured into the treatment target from accumulating to form large air bubbles and to be blown out. With the openings 1012*a*, it is also possible to prevent air bubbles from being captured into the treatment target. Accordingly, splashes and adhering of the treatment target to a wall face of the treatment vessel or the like can be prevented. The outside air may be considered as a gas inside the treatment vessel in which the treatment target has been placed. Note that the slit-like openings 1012*a* may not be provided.

In the two blades 101*a* and 101*b* of one blade pair 10 attached so as to face each other, at least bent sections, that is, sections that are in contact with the bent portions 1013, of the blade outer portions 1012, which are the portions that are bent toward the facing side, are preferably provided with openings (not shown). It is preferable that the openings are each provided at a position including a portion that intersects the symmetry plane of the blade 101. The position including a portion that intersects the symmetry plane of the blade 101 may be considered as the center in the width direction of the blade 101. It is also possible to consider that, in the mixing impeller 1 of this embodiment, the slit-like openings 1012*a* also function as the openings at the bent portions 1013. With such openings, effects similar to those of the openings 1012*a* described above can be achieved.

In the portion extending from the rotational shaft 20 side toward the bent portion 1013 at which the blade outer portion 1012 is bent, of each of the two blades 101*a* and 101*b* included in one blade pair 10, the portion that intersects the symmetry plane of the blade 101 is bent so as to project toward the side opposite to the side on which the two blades 101*a* and 101*b* face each other, described otherwise as angled outwardly, wherein outwardly is in a direction opposite an area between the blades of the blade pair 10. The portion extending from the rotational shaft 20 side of the blade 101 toward the bent portion 1013 at which the blade outer portion 1012 is bent is, for example, the blade inner portion 1011. This aspect may be considered as a state in which the blades 101*a* and 101*b* are each bent such that the blade inner portion 1011 is recessed on the side on which the blades 101*a* and 101*b* face each other, along the direction in which the blade inner portion 1011 extends. The portion that intersects the symmetry plane of the blade 101 may be considered as the center in the width direction of the blade 101. The portion not bent toward the facing side is, for example, the blade inner portion 1011. The side opposite to the side on which the blades 101*a* and 101*b* face each other is, for example, the outer side of the two blades 101*a* and 101*b*. For example, the blade inner portion 1011 is bent such that both sides thereof are oriented toward the side on which the two blades 101 of one blade pair 10 face each other, along the direction in which the blade inner portion 1011 extends. There is no limitation on the angle, on the side on which the two blades 101 face each other, of the portion that is bent in a projecting manner, but it is preferably an obtuse angle. The angle in this example may be considered, for example, as an angle, of the blade inner portion 1011, in a cross-section that is perpendicular to the direction extending from the central shaft 20 side toward the blade outer portion 1012, that is, toward the outer circumference, or may be considered as an angle in a cross-section that is perpendicular to the direction in which the ridge of the blade inner portion 1011 extends. Since the portion that intersects the symmetry plane of the blade 101, of each of the portions of the two blades 101 not bent toward the facing side (i.e. inwardly), is bent so as to project toward the side opposite to the side on which the blades 101 face each other in this manner (i.e. outwardly), when the blades 101 are pushed into the treatment target from the outside of the treatment target, the outside air captured by the blades 101 can be caused to accumulate in the bent portions. Accordingly, the outside air that has accumulated can be gradually released into the treatment target, for example, from the above-described slit-like openings 1012*a*, the openings in contact with the bent portions 1013, or later-described openings 1011*a* between the blade inner portions 1011 and the rotational shaft 20, and thus it is possible to prevent the outside air captured into the treatment target from accumulating to form large air bubbles and to be blown out.

Furthermore, in this embodiment, the blades 101*a* and 101*b* are attached to the rotational shaft 20 such that openings 1011*a* are formed between the portions extending from the rotational shaft 20 sides of the blades to the bent portions 1013, that is, the blade inner portions 1011, and the rotational shaft 20. Accordingly, during mixing, the outside air that has accumulated in the bent portions of the blade inner portions 1011 that intersect the symmetry plane of the blades 101 can be discharged into the treatment target via the openings 1011*a*, and thus bubbling can be performed on the treatment target. There is no limitation on the arrangement of the openings 1011*a* on the rotational shaft 20 side. Also, there is no limitation on the shape and the like of the openings 1011*a*. The state in which the blades are attached such that the openings 1011*a* are formed between the blade inner portions 1011 and the rotational shaft 20 may be considered as a concept that encompasses that openings are provided on the rotational shaft 20 sides of the blade inner portions 1011.

In this embodiment, the portion that intersects the symmetry plane of each of the blades 101*a* and 101*b*, of each of the portions of the two blades 101*a* and 101*b* not bent toward the facing side (e.g., the blade inner portion 1011) is bent, but, in the present invention, it is also possible that this portion is not bent. For example, the two blades 101 may be each a blade constituted by a plane that is orthogonal to a plane perpendicular to the rotational shaft 20. The two blades 101 may each have a shape, for example, that is symmetric about a symmetry plane perpendicular to the rotational shaft 20, and that is bent such that at least part of its portion that intersects the symmetry plane is bent. The state in which the blade 101 is bent at its portion that intersects the perpendicular plane may be considered as a state in which the center in the width direction of the blade 101 is bent along the direction in which the blade extends. It is also possible that the blade inner portion 1011 is bent to form a curved face.

There is no limitation on the angle formed by two blades 101 of one blade pair 10. The angle formed by the two blades 101 is, for example, an angle (note that this angle is a smaller angle) formed by straight lines or planes connecting the bent portions 1013 of the two blades 101 and the central axis of the rotational shaft 20. The portions, of the bent portions 1013, that are connected to the central axis of the rotational shaft 20 via straight lines in this example may be considered, for example, as portions similar to those of the bent portions 1013 that are used as a reference of the length of the blade inner portions 1011 as described above. If the blade inner portions 1011 are constituted by flat plates, the angle formed by the two blades 101 of one blade pair 10 in this example may be considered as an angle formed by the two flat plates that are the blade inner portions 1011 of the two blades 101. If the blade inner portions 1011 of the two blades 101 of one blade pair 10 are bent at their portions that intersect the symmetry plane of the blades 101, and the bent portions are in the shape of linear ridges, the angle formed by the two blades 101 of one blade pair 10 may be considered as an angle formed by the two linear ridges of the blade inner portions 1011 of the two blades 101. The angle formed by the two blades 101 of one blade pair 10 may be considered as an angle formed by straight lines along both sides of the blade inner portions 1011 of the two blades 101, or may be considered as an angle formed by directions in which the two blades 101 of the one blade pair 10 extend. In either case, the angle formed by the two blades 101 is, for example, preferably less than 90 degrees, more preferably from 30 to 70 degrees, and even more preferably from 45 to 60 degrees.

It is preferable that two blades 101 included in one blade pair 10 have shapes, for example, that are symmetric about a plane. For example, it is preferable that two blades 101 included in one blade pair 10 have shapes that are symmetric about a plane including the central axis of the rotational shaft 20. Specifically, it is preferable that two blades 101 included in one blade pair 10 have shapes that are symmetric about a plane extending along a bisector of the portion on the rotational shaft 20 side of the two blades 101 or the angle formed by the directions in which the blade inner portions 1011 of the two blades 101 extend, and the central axis of the rotational shaft 20.

It is preferable that the angles at which the two blade pairs 10 are arranged around the rotational shaft 20 are equal to each other. The state in which multiple blade pairs 10 are arranged around the rotational shaft 20 at equal angles is, for example, a state in which multiple blade pairs 10 are arranged such that the angles formed by the blade pairs 10 that are adjacent to each other and centered about the rotational shaft 20 when viewed from the axial direction of the rotational shaft 20 are equal angles. The same applies to multiple blades 101 and the like.

Furthermore, in this embodiment, a case is described in which two blade pairs 10 are provided, but it is also possible that three or more blade pairs 10 are provided. Also in the case in which three or more blade pairs 10 are provided, it is preferable that the blade pairs 10 are attached such that the blade pairs 10 are arranged around the rotational shaft 20 at equal angles. Note that, if the number of blade pairs 10 is too large, the flowability during mixing may deteriorate. Also, there is a physical limitation in the number of blade pairs that can be attached to the rotational shaft 20. Accordingly, it is preferable that the number of blade pairs 10 is two or three.

For example, it is also possible to use a mixing impeller 1*a* including three blade pairs 10 as in a first modified example shown in FIG. 3(*a*), instead of the mixing impeller 1.

In this embodiment, a case is shown as an example in which the mixing impeller 1 has the plate-like members 102, but it is also possible that the mixing impeller 1 does not have the plate-like members 102. As described above, when the plate-like members 102 are pulled out of the treatment target during mixing, depending on the treatment target, splashes of the treatment target that has been caught on the plate-like members 102 to a wall face of the treatment vessel or the like may occur, and thus it may be preferable not to provide the plate-like members 102 in some cases. In the mixing impeller 1 shown in this embodiment, the blades 101 are attached to the rotational shaft 20 via the plate-like members 102 and the fixing members 103, and thus if the plate-like members 102 are not provided, it is necessary to newly provide unshown members for attaching the blades 101 to the rotational shaft 20, or to attach the blades 101 directly to the rotational shaft 20 or the fixing members 103.

For example, it is also possible to use a mixing impeller 1*b* not having plate-like members as in a second modified example shown FIG. 3(*b*). In two blades 201*a* and 201*b* included in each of the two blade pairs 10*b* of the mixing impeller 1*b*, the portions on the side opposite to the rotational shaft 20 (i.e., blade outer portions 1012*b* that are portions on the outer circumferential side) are bent at bent portions 1013*b* toward the side on which the two blades 201*a* and 201*b* face each other. In the mixing impeller 1*b*, blade inner portions 1011*b* of the blades 201*a* and 201*b* constituting the two blade pairs 10*b* are each constituted by a flat plate, and the blades 201*b* are attached to a cylindrical fixing member 104 including a through hole 104*a* through which the rotational shaft 20 is to be inserted. In this example, an example is shown in which the blade outer portions 1012*b* are not provided with slit-like openings or the like. Note that it is also possible to provide slit-like opening or the like.

There is no limitation on the size and the like of the mixing impeller 1. The size of the mixing impeller 1 is determined, for example, according to the size, the shape, and the like of a treatment vessel (not shown) in which the mixing impeller 1 is arranged. There is no limitation on the material of the mixing impeller 1. The material of the mixing impeller 1 may be a metal such as stainless steel, or may be a resin or the like. For example, the blade inner portions 1011 and the blade outer portions 1012 of the blades 101 may be made of different materials. The same applies to the materials of the blades 101 and the plate-like members 102. It is also possible that portions of the blade inner portions 1011 are made of different materials. The same applies to the blade outer portions 1012. It is also possible that the blades 101 may be each constituted by a member in which different materials are layered one on the other. It is also possible that the surface of the blades 101 is coated by a material that is different from those in the other portions. The material of the mixing impeller 1 is determined, for example, according to at least one of a treatment target and a treatment method. There is no limitation on the thickness and the like of each member constituting the mixing impeller 1. For example, members constituting the blade inner portions 1011 and members constituting the blade outer portions 1012 of the blades 101 may have the same thickness, or may have different thicknesses. The blade inner portion 1011 may be constituted by a member with a uniform thickness, or may be constituted by a member with a non-uniform thickness, for example, a member whose thickness continuously changes from portion to portion or a member whose thickness intermittently changes from portion to portion.

There is no limitation on the width of the mixing impeller 1. The width of the mixing impeller 1 is, for example, a length of the mixing impeller 1, in a direction in which the rotational shaft 20 extends. The width of the mixing impeller 1 may be considered as the width of a blade 101 included in the mixing impeller 1, or may be considered as a length obtained by adding the width of a blade 101 included in the mixing impeller 1 and the thicknesses of the plate-like members 102 attached to both sides of the blade 101. For example, the width of the mixing impeller 1 is determined according to a length, in the rotational shaft direction, of the area in which the mixing impeller 1 is arranged, or the treatment target. For example, the width of the mixing impeller 1 may be a width obtained by subtracting at least the distance (e.g., a distance of approximately 1 to 100 mm) necessary to prevent the mixing impeller 1 from coming into contact with a partition plate or a wall face or the like in a treatment vessel, from the length, in the direction in which the rotational shaft 20 extends, of the area in which the mixing impeller 1 is arranged. Note that it is preferable that the width of the mixing impeller 1 is a length that is close to the length, in the direction in which the rotational shaft 20 extends, of the area in which the mixing impeller 1 is arranged, in order to improve the effect of the mixing.

Figure 4A:
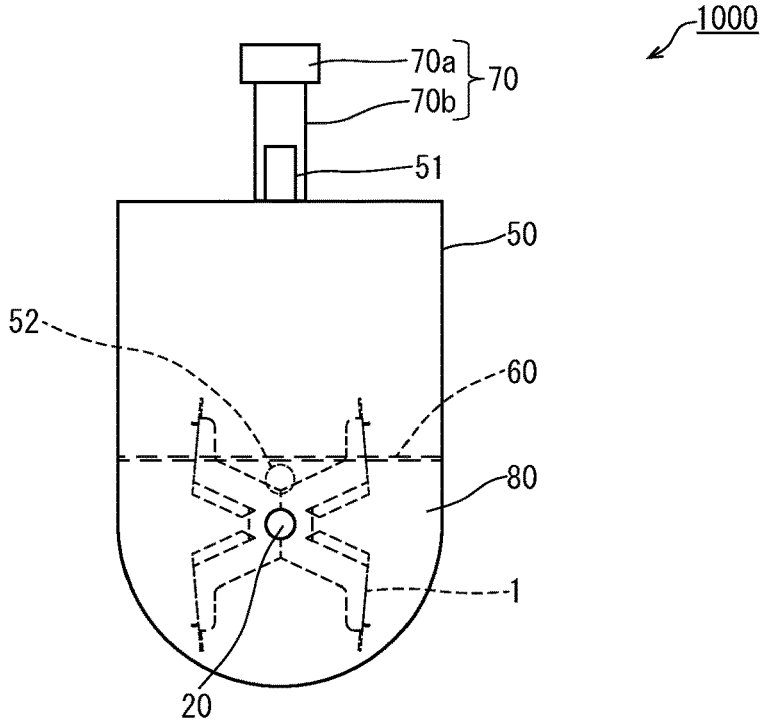
FIG. 4 shows a front view (FIG. 4(*a*)) and a cross-sectional view (FIG. 4(*b*)) showing an example of a treatment apparatus including the mixing impeller in the embodiment.
Figure 4B:
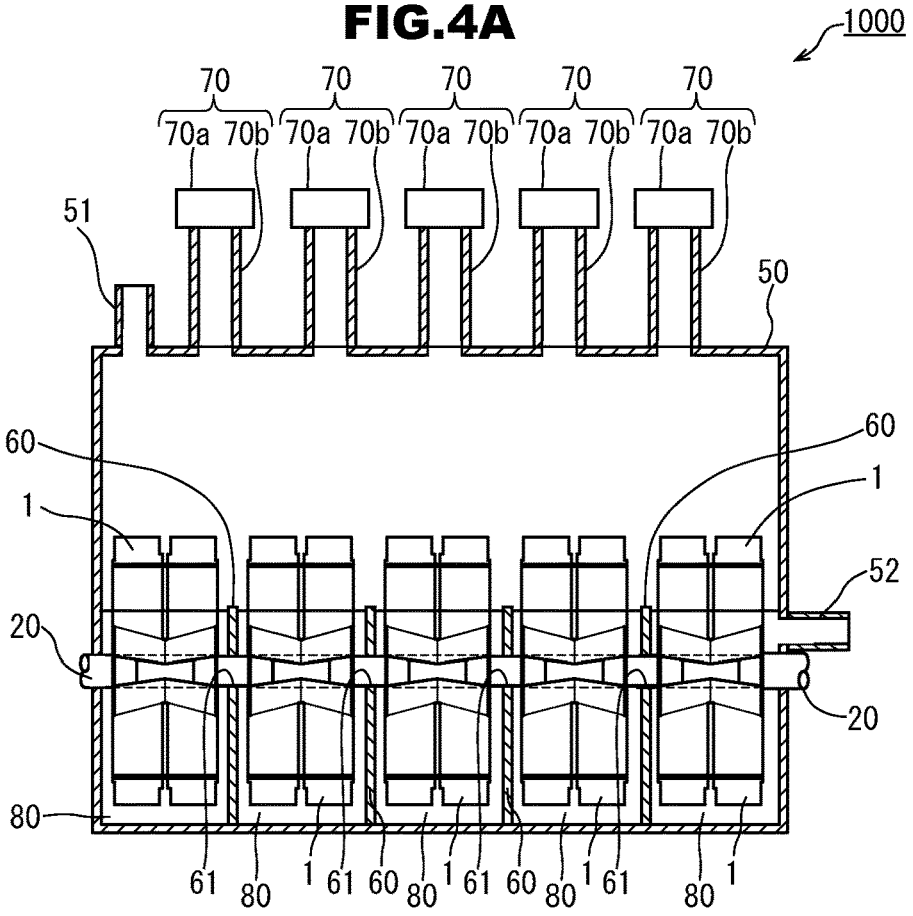

FIG. 4 shows a front view (FIG. 4(*a*)) and a side cross-sectional view (FIG. 4(*b*)) showing an example of a treatment apparatus 1000 including the mixing impeller 1 in this embodiment. FIG. 4(*b*) shows not a cross-sectional view but a side view of the mixing impeller 1.

The treatment apparatus 1000 is a treatment apparatus 1000 including five mixing impellers 1. In this example, a case will be described as an example in which the treatment apparatus 1000 is a lateral flow-type treatment apparatus in which microwave irradiation is performed.

The treatment apparatus 1000 includes a treatment vessel 50, four partition plates 60, a rotational shaft 20, five mixing impellers 1, and five microwave irradiating portions 70.

The treatment apparatus 1000 is an apparatus for treating a treatment target 80 that is placed in the treatment vessel 50. The treatment in this example is treatment that is performed through microwave irradiation. The treatment in this example is, for example, heating treatment through microwave irradiation, or treatment including heating treatment through microwave irradiation. In the treatment vessel 50, for example, microwave irradiation is performed in a multi-mode. The treatment apparatus 1000 is, for example, a treatment apparatus in which microwave irradiation is performed in a multi-mode.

The treatment vessel 50 has a shape extending in the lateral direction. The lateral direction in this example is similar to the lateral direction described above regarding the rotational shaft 20. The treatment vessel 50 is, for example, in the shape of a tube extending in the lateral direction. In this example, a case is shown in which a cross-section, that is perpendicular to the lateral direction, of the treatment vessel 50 is in the shape of the letter "U". Note that the treatment vessel 50 may have any shape as long as it is a shape extending in the lateral direction. For example, the treatment vessel 50 may be in the shape of a laterally long rectangular parallelepiped, capsule, or cylinder, or may be in the shape of a tube extending in the lateral direction and having a cross-section that is semi-circular or trapezoidal. The treatment vessel 50 may be arranged such that its bottom face and the like are horizontal or such that its bottom face and the like are inclined relative to a horizontal plane. For example, the treatment vessel 50 may have one or more legs (not shown) for holding the treatment vessel 50 such that its bottom face is inclined relative to a horizontal plane.

For example, the treatment target 80 is placed in the treatment vessel 50. The treatment target 80 will be described later. For example, the treatment target 80 is continuously or non-continuously supplied to the treatment vessel 50. The treatment vessel 50 has, for example, a supply opening 51 for supplying the treatment target 80 into the internal portion of the treatment vessel 50, and a taking-out opening 52 for taking out the treatment target 80 from the internal portion. The supply opening 51 may be considered, for example, as a loading opening. The taking-out opening 52 may be considered, for example, as a discharge opening or a collecting opening. In this example, the supply opening 51 is provided on the upper portion at one end in the lateral direction of the treatment vessel 50, and the taking-out opening 52 is provided on an end face located on the side opposite to the supply opening 51, in the lateral direction of the treatment vessel 50. The taking-out opening 52 is attached, for example, at a height that is lower than the height of the treatment target 80 at the end at which the taking-out opening 52 of the treatment vessel 50 is provided. There is no limitation on the positions at which the supply opening 51 and the taking-out opening 52 are provided, as long as the treatment target 80 that has been loaded into the treatment vessel 50 can be taken out from the taking-out opening 52. For example, if the supply opening 51 of the treatment target 80 is provided at a height that is the same as or higher than the height at which the taking-out opening 52 is provided, the treatment target 80 that has been supplied from the supply opening 51 naturally flows through the treatment vessel 50 from the supply opening 51 toward the taking-out opening 52, and is discharged from the taking-out opening 52, and thus the treatment vessel 50 can be used as a so-called flow-type treatment vessel. If the treatment vessel 50 is used as a flow-type treatment vessel, for example, the heights of the multiple partition plates 60 (or the lower sides of openings of the partition plates 60, etc.) may be set so as to be sequentially lower to the direction in which the treatment target flows, the heights of the multiple partition plates 60 may be set to be the same and the treatment vessel 50 itself may be inclined using unshown legs or the like with different heights, or these arrangements may be used in combination. There is no limitation on the shape, the number, and the like of the supply opening 51 and the taking-out opening 52.

The treatment vessel 50 is a vessel that is sealed at least at the portions other than the portions at which the supply opening 51 and the taking-out opening 52 are provided and the portions to which the microwave irradiating portions 70 are attached. Note that, if microwave irradiation is not performed or according to use applications or the like, the treatment vessel 50 does not have to be sealed, and, for example, its upper face may have an opening.

The treatment vessel 50 may have a heating unit (not shown) or the like such as a heater or a hot water jacket for heating the internal portion. Also, the treatment vessel 50 may have a cooling unit (not shown) or the like such as a cooler or a refrigerant jacket for cooling the internal portion.

There is no limitation on the material and the like of the treatment vessel 50. It is preferable that the inner wall of the treatment vessel 50 is made of a microwave reflecting material. Examples of the microwave reflecting material include a metal.

The partition plates 60 are arranged inside the treatment vessel 50 so as to intersect the direction in which the treatment vessel 50 extends. In this example, for example, the partition plates 60 are arranged inside the treatment vessel 50 so as to be perpendicular to the direction in which the treatment vessel 50 extends. The partition plates 60 are attached to the bottom face side inside the treatment vessel 50. The partition plates 60 are arranged such that there is a gap between the partition plates 60 and the upper face of the internal portion of the treatment vessel 50. For example, there is a gap between the upper portions of the partition plates 60 and the upper face in the treatment vessel 50 such that the treatment target can move through the gap. The state in which the partition plates 60 are arranged such that there is a gap between the partition plates 60 and the upper face of the internal portion of the treatment vessel 50 may be considered as a state in which the partition plates 60 are arranged so as to have an opening between the partition plates 60 and the upper face of the internal portion of the treatment vessel 50. For example, in this example, the upper portions of the partition plates 60 are arranged so as to be horizontal, the upper portions of the partition plates 60 are not in contact with the upper face of the internal portion of the treatment vessel 50, and an opening is provided between the upper portions of the partition plates 60 and the upper face of the internal portion of the treatment vessel 50. The upper portions of the partition plates 60 may be provided with one or more recesses and projections. For example, the upper portions of the partition plates 60 may be provided with one or more grooves, or may be provided with one or more notches. The upper portions of the partition plates 60 do not absolutely have to be arranged so as to be horizontal. For example, it is also possible that the upper portions of the partition plates 60 are arranged so as to be inclined, are in the shape of the letter "V", or are recessed in the shape of an arch.

The height of the partition plates 60 is set to a height that allows, for example, the treatment target 80 loaded into the treatment vessel 50 to move while flowing over the partition plates 60. The height of the partition plates 60 is a distance from the lower end of the partition plates 60 to the upper side of the partition plates 60. The height of the partition plates 60 may be a height that is equal to or lower than the height at which the rotational shaft 20 is provided, or may be a height that is higher than the height at which the rotational shaft 20 is provided. In this example, the height of the partition plates 60 is set such that the upper side of the partition plates 60 is higher than the rotational shaft 20, and is lower than the highest height of the mixing impellers 1 when the mixing impellers 1 rotate. The height of the partition plates 60 may be considered as a distance from the lower end of the partition plates 60 to the upper portion of the partition plates 60.

The multiple partition plates 60 in this example are arranged at equal intervals, but it is also possible that they are not arranged at equal intervals.

The rotational shaft 20 is arranged inside the treatment vessel 50 along the direction in which the treatment vessel 50 extends. Note that at least one end of the rotational shaft 20 extends to the outside of the treatment vessel 50. The rotational shaft 20 is connected to an unshown rotating apparatus such as a motor. The rotational shaft 20 and the rotating apparatus may be directly connected to each other, or may be connected to each other via at least one or more of a gear, a belt, and a chain such that rotation of the rotating apparatus is transmitted to the rotational shaft 20. The rotational shaft 20 is provided at the center in the width direction of the treatment vessel 50. The width direction of the treatment vessel 50 is a direction perpendicular to the direction in which the treatment vessel 50 extends. Note that the rotational shaft 20 does not have to be provided at the center in the width direction. The rotational shaft 20 is provided inside the treatment vessel 50, at a position that is lower than the surface of the treatment target 80, but it is also possible that it is provided at a position that is higher than the surface. In this example, the rotational shaft 20 is provided at a position that is lower than the upper sides of the partition plates 60, and thus the partition plates 60 are provided with holes 61 through which the rotational shaft 20 is to be inserted, and the rotational shaft 20 is inserted into these holes and is arranged inside the treatment vessel 50 along the direction in which the treatment vessel 50 extends.

The treatment apparatus 1000 includes the mixing impellers 1 in areas defined by one or more partition plates 60 inside the vessel 50. Five mixing impellers 1 are each attached to the rotational shaft 20. The mixing impellers 1 are each attached around the rotational shaft 20 extending in the lateral direction, for example, such that the blades 101*a* and 101*b* of each of multiple blade pairs 10 included in the mixing impellers 1 are positioned at the same position in the axial direction of the rotational shaft 20. When the rotational shaft 20 rotates, the five mixing impellers 1 simultaneously rotate. The five mixing impellers 1 are respectively arranged in the areas defined by the partition plates 60 inside the treatment vessel 50. In this example, a case is described in which the five mixing impellers 1 are attached to one rotational shaft 20, it is also possible that at least some of the five mixing impellers 1 are attached to different rotational shafts 20. In this case, the different multiple rotational shafts 20 may or may not be arranged on the same straight line.

The rotational speed of the mixing impellers 1 is, for example, the rotational speed of the rotational shaft 20, and is set by controlling the rotating apparatus or the like connected to the rotational shaft 20. The rotational speed of the mixing impellers 1 is, for example, preferably from 5 to 60 rpm (rotation per minute), and more preferably from 15 to 30 rpm. Note that the rotational speed may be other rotational speeds.

In this example, each mixing impeller 1 has a width that is smaller than the length, in the direction in which the rotational shaft 20 extends, of an area defined by the partition plates 60 in which that mixing impeller 1 is arranged. The mixing impeller 1 that is arranged in an area defined by two partition plates 60 is arranged so as to be away from the two partition plates 60 adjacent thereto, for example, by at least 1 mm. In this example, for example, the width of the mixing impeller 1 is a length that is shorter than the gap between the two partition plates 60 by 12 mm, and the mixing impeller 1 is arranged so as to be away from each of the two partition plates 60 by 6 mm. The same applies to the width and the arrangement of a mixing impeller 1 that is arranged in an area defined by one partition plate 60 and a wall face positioned in the longitudinal direction of the treatment vessel 50. Note that the numerical values mentioned herein are merely an example, and the width of the mixing impeller 1, the gap between the mixing impeller 1 and the partition plates 60, the gap between the mixing impeller 1 and a wall face positioned in the longitudinal direction of the treatment vessel 50, and the like can be set as appropriate.

The size of each mixing impeller 1 is determined, for example, according to the length, in the width direction, of the internal portion of the treatment vessel 50. The size of the mixing impeller 1 is set such that, for example, the diameter of a circle that is described by an end of a blade of the mixing impeller 1 when the mixing impeller 1 rotates is shorter than the width of the internal portion of the treatment vessel 50 by at least 1 mm.

Examples of the treatment apparatus 1000 shown in FIG. 4 include an apparatus including a treatment vessel 50 in which the semi-circular portion on the lower side in a cross-section in the width direction has a radius of about 500 to 700 mm, and a mixing impeller 1 in which the distance from the central axis of the rotational shaft 20 to an outer end of a blade 101 (i.e., an end, of the blade outer portion 1012, on the side opposite to the bent portion 1013) is shorter than the above-described radius by about 30 to 50 mm. Note that the numerical values mentioned herein are merely an example, and it is also possible to use the treatment vessels 50 and mixing impellers 1 with other sizes.

In this example, the size of the mixing impellers 1, the position in the height of the rotational shaft 20, the height of the partition plates 60, and the like are set such that, when the mixing impellers 1 rotate, part of the mixing impellers 1 is exposed to the outside of the treatment target 80 in the treatment vessel 50, but it is also possible that they are set such that the mixing impellers 1 are not exposed to the outside of the treatment target 80.

In this example, a case is shown as an example in which the treatment apparatus 1000 includes five mixing impellers 1, but there is no limitation on the number of mixing impellers 1 included in the treatment apparatus 1000, as long as it is one or at least two. The multiple mixing impellers 1 typically rotate in the same direction inside the treatment apparatus 1000, but it is also possible that some of the multiple mixing impellers 1 rotate in a direction different from that of other mixing impellers 1. For example, the rotational directions of adjacent mixing impellers 1 may be set to be opposite directions. All of the multiple mixing impellers 1 may be attached to the rotational shaft 20 at the same angle, or at least some of them may be attached at different angles. For example, adjacent mixing impellers 1 may be attached to the rotational shaft 20 at different angles. Three or more mixing impellers 1 attached to the rotational shaft 20 so as to be successively adjacent to each other may be attached at sequentially different angles along the direction in which the mixing impellers 1 are arranged. The angles at which the multiple mixing impellers 1 are attached are, for example, angles that are formed by the blade 101 included in the multiple mixing impellers 1 when the blade 101 are projected in the direction in which the rotational shaft 20 extends. The sizes of the multiple mixing impellers 1 (e.g., at least one of the width and the length of the blades 101, etc.) included in the treatment apparatus 1000 may be the same or different from each other. All of the multiple mixing impellers included in the treatment apparatus 1000 may be the same, or at least some of them may be different from each other. For example, the multiple mixing impellers included in the treatment apparatus 1000 may have the same number of blade pairs 10, or at least some of them may have different numbers of blade pairs 10. For example, the treatment apparatus 1000 may have one or more mixing impellers 1 including two blade pairs 10, and one or more mixing impellers 1*a* including three blade pairs 10 as shown in FIG. 3(*a*). For example, the treatment apparatus 1000 may have one or more mixing impellers 1, and one or more mixing impellers 1*b* as shown in FIG. 3(*b*).

Furthermore, the mixing impellers 1 may be or may not be arranged in areas defined by the partition plates 60. In this embodiment, a case is described in which one mixing impeller 1 is arranged in one area defined by partition plates 60, but, in the present invention, it is also possible that two or more mixing impellers 1 are arranged in one area defined by partition plates 60. For example, it is also possible that the multiple mixing impellers 1 are arranged around the same central shaft 20, in one area defined by partition plates 60. For example, it is also possible that the multiple mixing impellers 1 are arranged such that their central shafts 20 are arranged on the same straight line, in one area defined by partition plates 60, and, in this case, the central shafts 20 to which the multiple mixing impellers 1 are attached may not be the same shaft. The different multiple rotational shafts 20 may not be arranged on the same straight line. The two or more mixing impellers 1 are arranged in the direction in which the rotational shafts 20 extend, for example, at predetermined intervals. If the multiple mixing impellers 1 are arranged around the same central shaft 20 or if the multiple mixing impellers 1 are arranged such that their central shafts 20 are arranged on the same straight line, the multiple mixing impellers 1 are arranged, for example, such that their front faces are parallel to each other or their plate-like members 102 are parallel to each other. Also in this case, the angles in the rotational directions at the time of installation, of the two or more mixing impellers 1 arranged in one area defined by partition plates 60, may be the same, or at least some of them may be different from each other. Also in this case, the rotational directions, of the two or more mixing impellers 1 arranged in one area defined by partition plates 60, may be the same, or at least some of them may be different from each other. The sizes of the multiple mixing impellers 1 may be the same or different from each other.

The microwave irradiating portions 70 irradiate the internal portion of the treatment vessel 50 with microwaves. The microwave irradiating portions 70 in this example each include a microwave generating unit 70*a* that generates microwaves, and a waveguide 70*b* that guides the generated microwaves into the treatment vessel 50 so that the internal portion of the treatment vessel 50 is irradiated with the microwaves. The connecting section of the waveguide 70*b* and the treatment vessel 50 may be open or may be blocked by a microwave-transmitting material.

Five microwave irradiating portions 70 are arranged at equal intervals on a straight line, along the direction in which the treatment vessel 50 extends, on the upper portion of the treatment vessel 50. There is no limitation on the positions at which the microwave irradiating portions 70 are arranged. For example, it is also possible that the microwave irradiating portions 70 are not arranged at equal intervals on a straight line on the treatment vessel 50. It is also possible that the five microwave irradiating portions 70 are arranged in a concentrated manner at one or more points in the longitudinal direction of the treatment vessel 50. It is also possible that the microwave irradiating portions 70 are not arranged on a straight line.

In this example, a case is shown in which five microwave irradiating portions 70 are used, but there is no limitation on the number of microwave irradiating portions 70 included in the treatment apparatus 1000, as long as it is one or at least two. There is no limitation on the configuration of the microwave irradiating portions 70, and the configuration may be those other than the above-described configuration including the microwave generating unit 70*a* and the waveguide 70*b*, as long as it is possible to perform microwave irradiation.

In this example, a case is shown in which the treatment apparatus 1000 is an apparatus for performing treatment through microwave irradiation, but it is also possible that the treatment apparatus 1000 is an apparatus for performing treatment without using microwave irradiation. For example, the treatment apparatus 1000 also may be a treatment apparatus for performing heating treatment using a heating unit (not shown) such as a heater, a hot water jacket, or a steam jacket, or may be a treatment apparatus for performing cooling treatment using a cooling unit (not shown) such as a cooler or a refrigerant jacket. The treatment that is performed by the treatment apparatus 1000 also may be treatment that performs irradiation of ultrasonic waves, optical beams, or the like, or may be treatment that generates vibrations or the like. The treatment that is performed by the treatment apparatus 1000 also may be mixing treatment. The treatment that is performed by the treatment apparatus 1000 may be treatment obtained by combining two or more types of treatment.

The treatment target that is to be mixed by the mixing impellers 1 may be considered as a material that is to be mixed, as described above. The treatment target that is to be mixed by the mixing impellers 1 is, for example, the treatment target 80 that is to be treated by the treatment apparatus 1000. The treatment target that is to be mixed by the mixing impellers 1 may be a single material, or may be a mixture of two or more types of materials. The treatment target may be, for example, a material containing impurities and the like. The treatment target that is to be mixed is, for example, a material that can be mixed. The treatment target that is to be mixed is a material that flows. The treatment target that flows is, for example, a liquid treatment target. The liquid treatment target may be, for example, a material with a high flowability, such as water, oils, aqueous solutions, or colloidal solutions, or may be a material with a low flowability, such as slurries or suspensions. The treatment target that flows may be a solid such as powders, granules, or pellets, a mixture of a solid and a liquid, or the like.

If a product is produced from a raw material through a chemical reaction or the like in the treatment vessel 50 or the like, it may be considered that the treatment target inside the treatment vessel 50 contains the product. That is to say, the treatment target may be a raw material and/or a product. If esterification is performed in the treatment vessel 50, the treatment target may be, for example, oils and fats, and alcohols that are raw materials of esterification.

The treatment target 80 may be, for example, a mixture of one or at least two types of raw materials and one or at least two types of catalysts. A catalyst that is mixed with a raw material may be a heterogeneous catalyst such as a solid catalyst, or may be a homogeneous catalyst such as a liquid catalyst. The solid catalyst may or may not form a fluidized bed inside the treatment vessel 50.

Hereinafter, an experiment for checking a mixed state and raising of a treatment target performed regarding the mixing impellers 1 of this embodiment will be described.

Figure 5A:
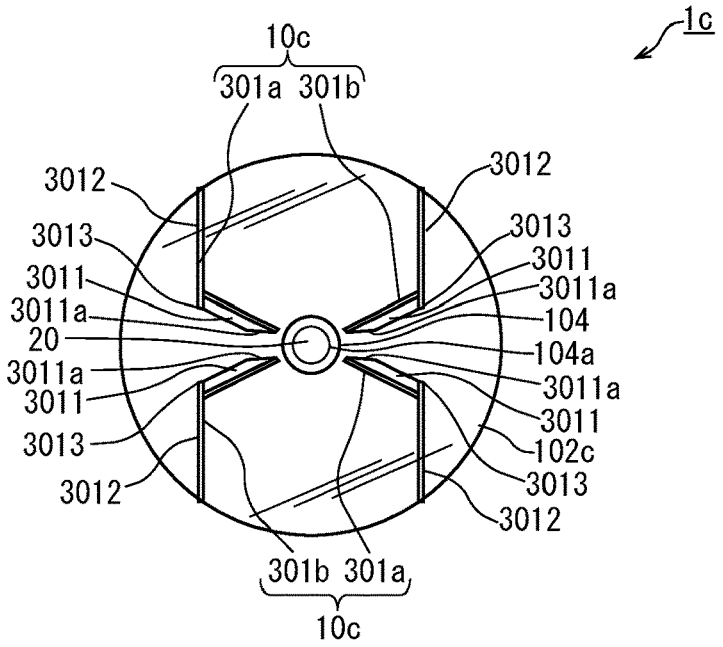
FIG. 5 shows a front view (FIG. 5(*a*)) showing a mixing impeller corresponding to the mixing impeller of this embodiment used in an experiment for checking a state of a treatment target mixed by the mixing impeller, a front view (FIG. 5(*b*)) showing a first comparative mixing impeller used in a control experiment, and a front view (FIG. 5(*c*)) showing a second comparative mixing impeller used in a control experiment.
Figure 5B:
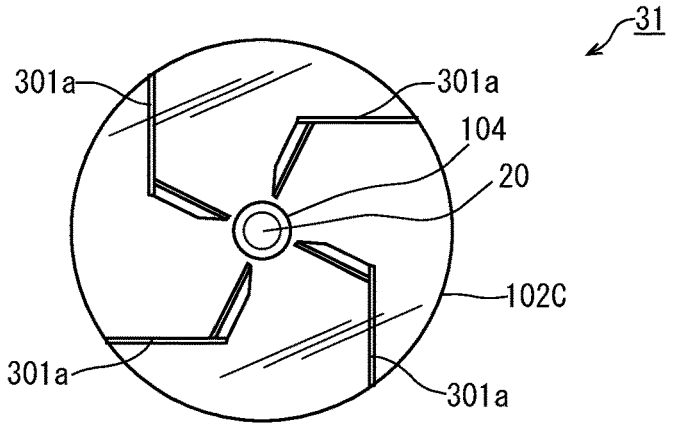
Figure 5C:
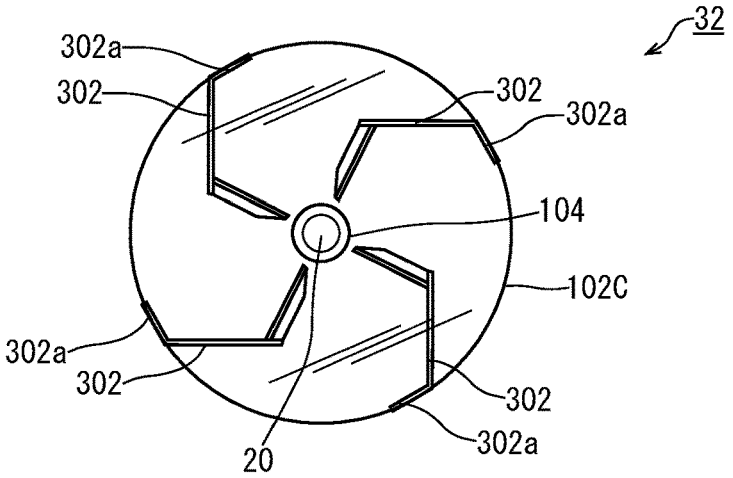

FIG. 5 shows a front view (FIG. 5(*a*)) showing a mixing impeller 1*c* corresponding to the mixing impeller 1, the mixing impeller 1*c* being a mixing impeller used in an experiment for checking a state of a treatment target mixed by the mixing impeller of this embodiment, and a front view (FIG. 5(*b*)) showing a first comparative mixing impeller and a front view (FIG. 5(*c*)) showing a second comparative mixing impeller used in control experiments.

Figure 6A:
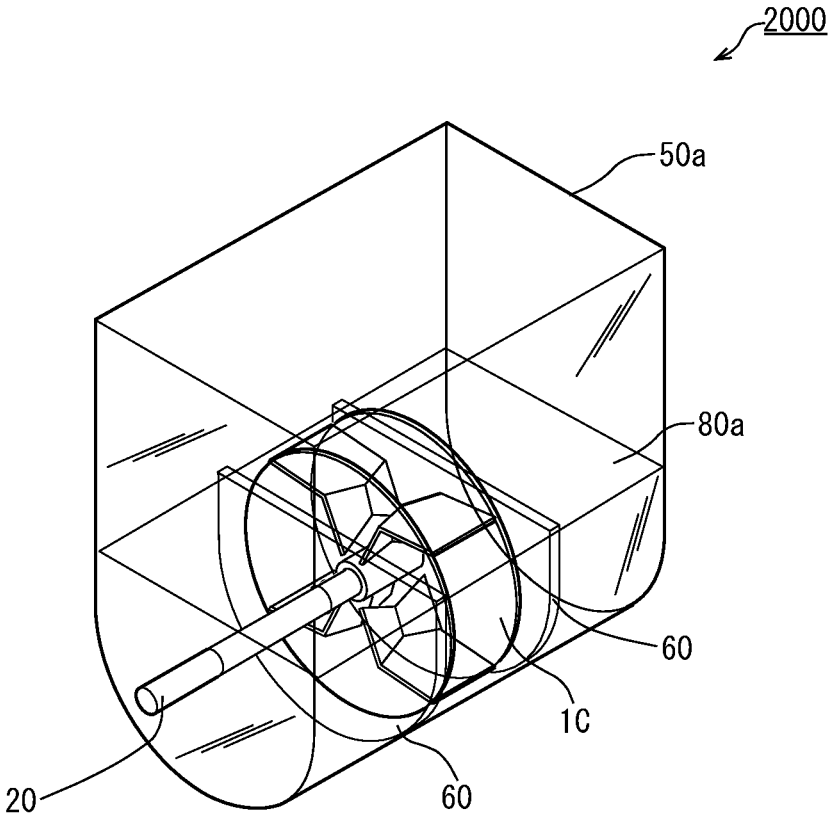
FIG. 6 is a view showing an experimental apparatus used in an experiment for checking a state of a treatment target mixed by the mixing impeller in the embodiment.
Figure 6B:
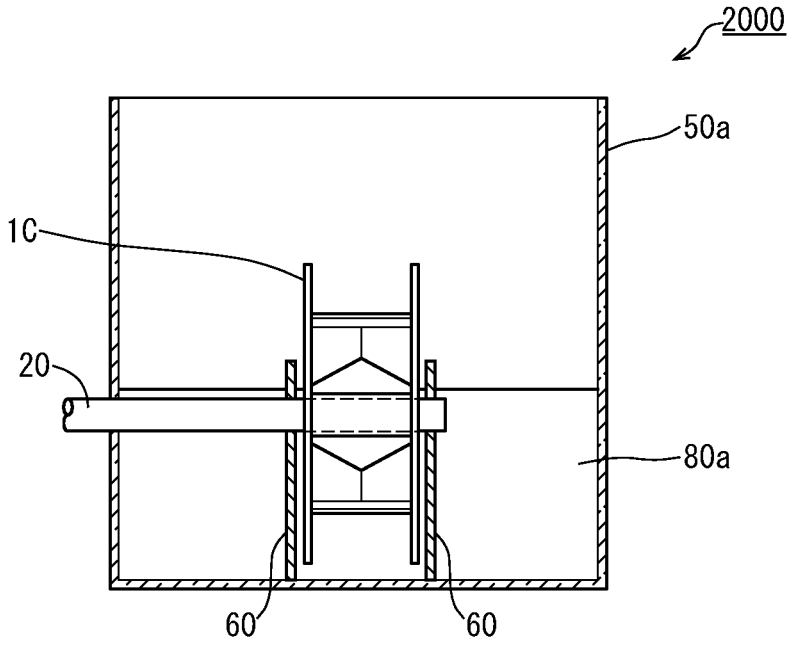

FIG. 6 is a view showing an experimental apparatus 2000 used in an experiment for checking a state of a treatment target mixed by the mixing impeller of this embodiment.

As shown in FIG. 6(*a*), the mixing impeller 1*c* is an experimental mixing impeller corresponding to the mixing impeller 1, and, as in the mixing impeller 1, has two blade pairs 10*c* that are at the same position in the axial direction of the rotational shaft 20 and are arranged around the rotational shaft 20 at equal angles relative to the rotational shaft 20. The blade pairs 10*c* are similar to the blade pairs 10 shown in FIG. 1, and each have a blade 301*a* and a blade 301*b* that are similar to the blades 101*a* and 101*b* included in the blade pairs 10. Note that the size of the blade pairs 10*c*, the dimensions of each portion, and the like are different from those of the blade pairs 10 shown in FIG. 1. Note that, in a case in which the blades 301*a* and 301*b* of the mixing impeller 1*c* do not have to be particularly distinguished from each other, for the sake of ease of description, they may be each simply referred to as a blade 301. As in the blades 101*a* and 101*b* of the blade pairs 10 shown in FIG. 1, two blades 301*a* and 301*b* constituting each of the blade pairs 10*c* are formed so as to extend from the rotational shaft 20 side toward the outer circumferential side, which is the side opposite to the rotational shaft 20, that is, on the periphery of the impeller 1*c*, and the outer circumferential sides thereof are angled inwardly with respect to the blade inner portion 3011, i.e. bent toward the side on which the two blades 301*a* and 301*b* face each other. It is assumed that the outer circumferential side angled inwardly with respect to the blade inner portion 3011, that is to say, bent toward the side on which the blades 301*a* and 301*b* face each other is referred to as a blade outer portion 3012, the bent section is referred to as a bent portion 3013, and the portion of each blade 301 extending from the rotational shaft 20 side to the bent portion 3013 is referred to as a blade inner portion 3011. In this example, the bending angle of the blade outer portion 3012 relative to the blade inner portion 3011 is 120 degrees. The mixing impeller 1*c* used in this example includes plate-like members 102*c* in the shape of circles that cover the entire portions on both sides of the blade pairs 10*c*. The blade pairs 10*c* are indirectly attached to a cylindrical fixing member 104 including a through hole into which the rotational shaft 20 is to be inserted, by being attached to the plate-like members 102*c*. Note that, in the mixing impeller 1*c*, the slit-like openings 1012*a* and the like are omitted. As in the blade inner portion 1011, the blade inner portion 3011, which is a portion on the rotational shaft 20 side of each of the blades 301*a* and 301*b*, is such that the portion that intersects the symmetry plane is angled outwardly, wherein outwardly is in a direction opposite an area between the blades of the blade pair 10*c* (i.e. bent so as to project toward the side opposite to the side on which the blades 301*a* and 301*b* face each other). The length of the portion that intersects the symmetry plane, of the portion that is bent in a projecting manner, (or stated as angled outwardly) that is, the portion corresponding to a ridge is 15 mm, and the length of the portion that is in contact with each plate-like member 102*c*, of the blade inner portion 3011, is 30 mm. An opening 3011*a* corresponding to the opening 1011*a* is formed between the blade inner portion 3011, which is the portion extending from the rotational shaft 20 sides of each of the blades 301*a* and 301*b* to the bent portion 3013, and the rotational shaft 20. The length of the portion that is in contact with each plate-like member 102*c*, of the blade outer portion 3012, is 32 mm. The distance from the portion that is in contact with the ridge of the blade inner portion 3031, of the blade outer portion 3012, to the end on the side opposite to the rotational shaft 20 of the blade 301 is 57 mm. The distance from the end on the side opposite to the rotational shaft 20 of the blade 301 to the fixing member 104 is 53.5 mm. The width of the blade 301 is 95 mm. The diameter of the rotational shaft 20 is 20 mm.

The mixing impeller 1*c* is made of a transparent resin with a thickness of 2 mm, so that status of the treatment target that is being mixed can be visually checked. The same applies to a first comparative mixing impeller 31 and a second comparative mixing impeller 32.

The size of the entire mixing impeller 1*c* is set such that the diameter of a circle that is described by an end of the blade 301 (e.g., an end that is farthest from the rotational shaft 20 of the blade 301) when the mixing impeller 1*c* rotates is 115 mm. The same applies to a first comparative mixing impeller 31 and a second comparative mixing impeller 32. In this example, it is assumed that all of the mixing impeller 1*c*, the first comparative mixing impeller 31, and the second comparative mixing impeller 32 are attached to the rotational shaft 20 so as to rotate to the right when viewed from the front, that is, rotate clockwise.

The first comparative mixing impeller 31 is obtained by omitting the blades 301*b* from the mixing impeller 1*c* and providing four blades 301*a*. That is to say, the first comparative mixing impeller 31 includes four blades 301*a* whose portions on the side opposite to the rotational shaft 20 are bent in the rotational direction. The four blades 301*a* are arranged around the rotational shaft 20 at equal angles, specifically, at intervals of 90 degrees. As in the blades 301*a* of the mixing impeller 1*c*, the blades 301*a* are attached to the plate-like members 102*c* in the shape of circles. The other aspects of the configuration, the size, and the like are similar to those of the mixing impeller 1*c*.

The second comparative mixing impeller 32 is obtained by omitting the blades 301*b* from the mixing impeller 1*c*, and providing four blades 302 obtained by attaching plate-like extension members 302*a* to ends of the blades 301*a* on the side opposite to the rotational shaft 20. Specifically, the second comparative mixing impeller 32 is obtained by omitting the blades 301*b* from the mixing impeller 1*c*, and providing four blades 302 obtained by attaching plate-like extension members 302*a* to portions of the blades 301*a* on the outer circumferential side of the blade outer portions 3012. The extension members 302*a* are bent in the rotational direction of the rotational shaft 20, relative to the blade outer portions 3012. The state of being bent in the rotational direction of the rotational shaft 20 is, for example, a state of, when a circle that is centered about a point on the central axis of the rotational shaft 20 and that is perpendicular to the axial direction of the rotational shaft 20 is rotated in the same direction as the rotational shaft 20, being bent in the direction in which the circle rotates. The extension members 302*a* are each a rectangular member with a length of 10 mm, a width of 95 mm, and a thickness of 2 mm, and are each attached so as to form an angle of 120 degrees relative to the blade outer portion 3012. That is to say, the second comparative mixing impeller 32 includes four blades 302 whose portions on the side opposite to the rotational shaft 20 are bent in two steps in rotational direction. The four blades 301*a* are arranged around the rotational shaft 20 at equal angles, specifically, at intervals of 90 degrees. The four blades 301*a* are attached at the same position in the axial direction of the rotational shaft 20. As in the blades 301*a* of the mixing impeller 1*c*, the blades 302 are attached to the plate-like members 102*c* in the shape of circles. The other aspects of the configuration, the size, and the like are similar to those of the mixing impeller 1*c*.

The experimental apparatus 2000 includes a treatment vessel 50*a*, the rotational shaft 20, the two partition plates 60, and the mixing impeller 1*c*. In control experiments, the first comparative mixing impeller 31 and the second comparative mixing impeller 32 are attached instead of the mixing impeller 1*c*.

The treatment vessel 50*a* has a shape similar to that of the treatment vessel 50 shown in FIG. 4, but the upper face, the supply opening 51, and the taking-out opening 52 have been omitted. The length in the longitudinal direction, the width, and the like are also different from those of the treatment vessel 50. The microwave irradiating portions 70 have been omitted as well. In this example, the treatment vessel 50*a* is made of a transparent resin. A treatment target 80*a* is placed inside the treatment vessel 50*a*. The height of the treatment vessel 50*a* when viewed from the front is 180 mm, and the width is 60 mm. The length in the longitudinal direction of the rotational shaft 20 is 300 mm. All of the lengths in this example are inside dimensions.

The rotational shaft 20 is provided so as to extend through the center of the semi-circular portion on the lower side of the treatment vessel 50*a* with a cross-section that is in the shape of the letter "U". The radius (inside dimension) of the semi-circular portion on the lower side of the internal portion of the treatment vessel 50*a* is 60 mm. The rotational shaft 20 is connected to a rotating apparatus (not shown) for rotating the rotational shaft 20, and can be rotated by rotating the rotating apparatus. The rotating apparatus has, for example, a motor (not shown) or the like. The number of rotations and the like of the rotating apparatus are controlled by an unshown control portion or the like.

The height of the two partition plates 60 is 90 mm, and the distance between the partition plates 60 in terms of an inside dimension is 100 mm. The upper sides of the partition plates 60 are arranged so as to be horizontal. The mixing impeller 1*c* and the like are arranged in the area defined by the partition plates 60. The mixing impeller 1*c* is arranged at the center in the longitudinal direction of the treatment vessel 50*a*.

The mixed states in which the mixing impeller 1*c*, the first comparative mixing impeller 31, and the second comparative mixing impeller 32 are respectively used as mixing impellers were visually checked while providing the treatment target 80*a* with a marker.

Furthermore, regarding the raising of the treatment target 80*a*, the height (height of the highest portion) of the treatment target 80*a* that had been raised during mixing with respect to that in an unmixed state was visually checked.

Treatment target: Butyl ester

Amount of treatment target (amount of fluid): Treatment target is placed up to the position 30 mm above the center of the rotational shaft 20.

Viscosity of internal fluid: 8.1 mPa·s

Temperature of internal fluid: 9° C.

Marker: glitter for artificial nails (obtained by making metal foil into a powder)

Number of rotations of mixing impeller: 25 rpm, 50 rpm

FIG. 7 is a table showing a result of the above-described experiment. In the table, the symbol circle showing a result of the mixed state indicates that the mixed state was good. The raising of fluid is the raising of the treatment target 80*a*.

As a result of the visual checking, it was seen in all mixing impellers used in the experiment at 25 rpm that the marker flowed, and no stagnation was seen. Accordingly, all mixing impellers had a good mixed state.

Regarding the raising of the treatment target 80*a*, the raising in the case of using the mixing impeller 1*c* was the smallest at both numbers of rotations of 25 rpm and 50 rpm. In the case in which the mixing impeller 1*c* was used, the flowability of the marker due to mixing was higher at a number of rotations of 50 rpm than at 25 rpm, but the raising was smaller at a number of rotations of 25 rpm.

This experiment was performed in a relatively small scale, and thus, in the case in which a mixing impeller 1 with a size that is twice or more the size of the mixing impeller 1*c* is used, it seems that the raising can be kept small if the number of rotations is approximately 12 rpm, in terms of the number of rotations according to the size of the mixing impeller, based on the number of rotations 25 rpm at which the raising was small.

Although a detailed description of the experimental content and the like has been omitted, from an experiment in which splashes of the treatment target to a wall face of the treatment vessel 50*a* were visually checked after mixing performed using the experimental apparatus 2000 as described above, using, in the first comparative mixing impeller 31 shown in FIG. 5(*b*), a mixing impeller (not shown) obtained by replacing the blades 301 by blades in which ends of the blades 301, specifically, the portions on the outer circumferential side are not bent in the rotational direction, that is, four rectangular blades, wherein the blades are connected to the rotational shaft 20 such that one side thereof is along the axial direction, and the mixing impeller 1*c* corresponding to the mixing impeller 1 of this application shown in FIG. 5(*a*), it was seen that splashes of the treatment target were smaller in the case of using the mixing impeller 1*c* corresponding to the mixing impeller 1 of this application.

As described above, according to the mixing impeller of this embodiment, it is possible to mix a treatment target in a state of suppressing raising of the treatment target while allowing the treatment target to flow during mixing, that is, it is possible to properly mix a treatment target. Accordingly, for example, in the case of using the treatment apparatus of this embodiment, it is possible to perform treatment while suppressing a deterioration in the quality.

Furthermore, according to the mixing impeller of this embodiment, it is possible to suppress splashes of a treatment target during mixing, that is, it is possible to properly mix a treatment target.

Furthermore, when splashes of a treatment target to a wall face of the treatment vessel or the like occur, the treatment target in the splashes may be dried or burnt and affect the quality of the treatment target, whereas, in the case of using the treatment apparatus of this embodiment, the mixing impeller 1 can perform mixing while suppressing splashes, and thus it is possible to perform treatment while suppressing a deterioration in the quality.

Note that the present invention is not limited to the embodiments set forth herein and may be variously modified, and such modifications are also encompassed in the scope of the invention.

As described above, the mixing impeller and the like according to the present invention are suitable as a mixing impeller for mixing a treatment target inside a treatment vessel, and is especially useful as a mixing impeller and the like for mixing a treatment target inside a lateral treatment vessel.

The invention claimed is:

1. A mixing impeller comprising: multiple blade pairs each having two blades, wherein each blade comprises a blade inner portion extending from a rotational shaft and a blade outer portion, wherein the blades included in the multiple blade pairs are attached around the rotational shaft extending in a lateral direction, so as to be positioned at a same point along the rotational shaft's length, the two blades of each blade pair each have a shape that is symmetric about a symmetry plane that is a plane perpendicular to the rotational shaft, and the two blades of each blade pair are formed so as to extend from the rotational shaft side toward an outer circumferential side, which is a side on a periphery of the impeller, and blade outer portions that are on the outer circumferential side are bent toward a side on which the two blades face each other, wherein, in the two blades of each blade pair, the blade outer portions that intersect the symmetry plane are provided with slit-like openings.

2. The mixing impeller according to claim 1, wherein each blade outer portion is bent so as to form an obtuse angle with the inner blade portion extending from the rotational shaft.

3. The mixing impeller according to claim 1, wherein, each blade inner portion that intersects the symmetry plane is bent so as to project toward a side opposite to the side on which the two blades face each other.

4. The mixing impeller according to claim 3, wherein each blade is attached to the rotational shaft so as to have an opening between the inner blade portion extending from the rotational shaft side toward the bent portion of the blade, and the rotational shaft.

5. The mixing impeller according to claim 1, further comprising plate-like members attached to both sides of the blades.

6. The mixing impeller according to claim 5, wherein the plate-like members attached to both sides of the blades have a shape extending beyond a structure of the blades in which the plate-like members conform to the bending of the blades.

7. The mixing impeller of claim 1, wherein the blades are located radially around a perimeter of the rotational shaft and each blade pair comprises two adjacent blades, and wherein the blade outer portions that are on the outer circumferential side are bent toward a side on which the two blades face each other such that the blade outer portions that are on the outer circumferential side are angled inwardly towards an area between the two blades of the blade pair.

8. A mixing impeller comprising: multiple blade pairs each having two blades, wherein each blade comprises a blade inner portion extending from a rotational shaft and a blade outer portion, wherein the blades included in the multiple blade pairs are attached around the rotational shaft extending in a lateral direction, so as to be positioned at a same point along the rotational shaft's length, the two blades of each blade pair each have a shape that is symmetric about a symmetry plane that is a plane perpendicular to the rotational shaft, and the two blades of each blade pair are formed so as to extend from the rotational shaft side toward an outer circumferential side, which is a side on the periphery of the impeller, and blade outer portions that are on the outer circumferential side are angled inwardly with respect to the blade inner portion, wherein inwardly is in a direction towards an area between the two blades of the blade pair, wherein, in the two blades of each blade pair, the blade outer portions that intersect the symmetry plane are provided with slit-like openings.

* * * * *